United States Patent [19]

Izumi

[11] 4,023,367

[45] May 17, 1977

[54] STEAM ENGINE FOR A MOTOR VEHICLE

[75] Inventor: Hisashi Izumi, Fujisawa, Japan

[73] Assignee: Nissan Motor Co., Ltd., Yokohama, Japan

[22] Filed: Jan. 23, 1976

[21] Appl. No.: 651,623

[30] Foreign Application Priority Data

Jan. 27, 1975 Japan ..... 50-11103

[52] U.S. Cl. ..... 60/693; 60/670

[51] Int. Cl.² ..... F01K 9/00

[58] Field of Search ..... 60/685, 690, 692, 670

[56] References Cited

UNITED STATES PATENTS

| | | | |
|---|---|---|---|
| 3,835,650 | 9/1974 | Chesmejef | 60/670 |
| 3,913,331 | 10/1975 | Conwell | 60/692 |

*Primary Examiner*—Allen M. Ostrager

[57] ABSTRACT

A steam generator is operated by heat generated by combustion of fuel, and supplies steam to an expander. An auxiliary condenser transfers some of the heat remaining in the steam from the expander to air used for burning the fuel.

4 Claims, 1 Drawing Figure

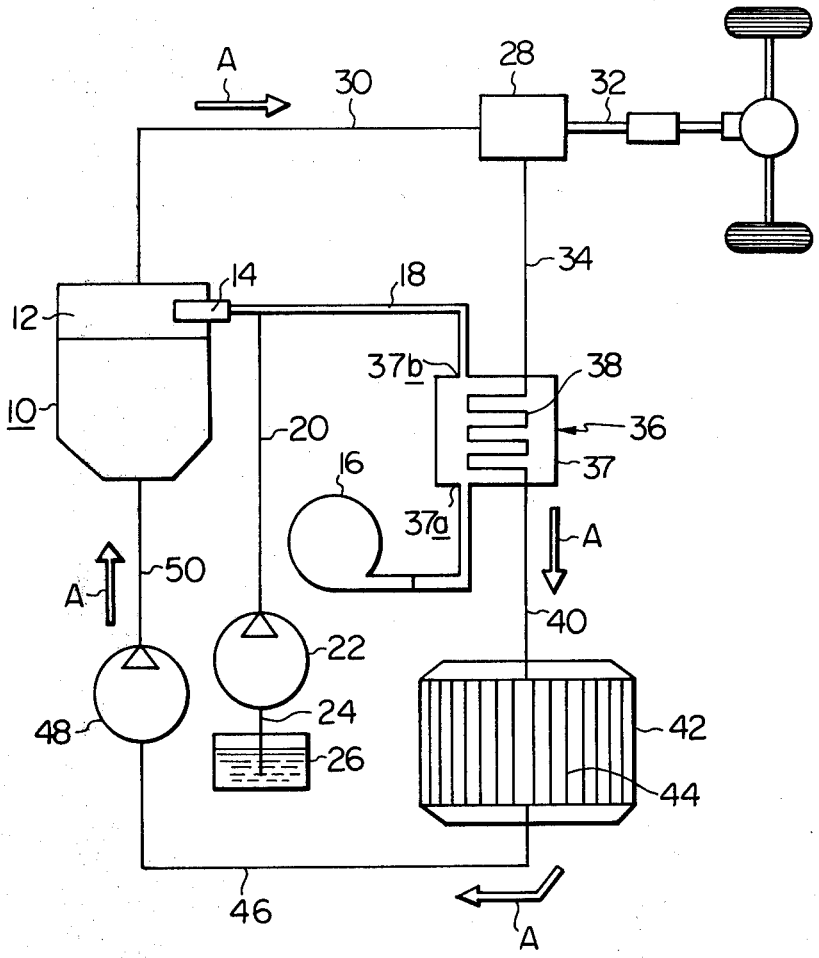
A
30
28
32
34
14
18
12
37b
38
10
20
36
16
37
37a
A
50
A
40
22
24
48
26
42
44
46
A

STEAM ENGINE FOR A MOTOR VEHICLE

The present invention relates in general to a steam engine system for a motor vehicle and more particularly to a steam condenser, of the steam engine system, used for condensing steam, used as the working fluid, to water by removal of the latent heat of the steam.

It has been well known to those skilled in the art to use a steam engine system as a prime mover of a motor vehicle by reason that such kind of engine system produces almost no harmful compounds such as HC, CO and NOx. The steam engine system utilized in the the motor vehicle is a type of so-called "closed-Rankine cycle engine system" in which steam at high temperature and high pressure from a steam generator is introduced into an expander for generating mechanical power, and steam from the expander is condensed to water in a condenser, and then the water is supplied into the prior mentioned steam generator in a recirculating manner.

In such kind of steam engine system, however, the condenser employed must be large in size due to the large and critical cooling requirement. So, if a prior art steam engine system is mounted in a motor vehicle, for example in a passenger vehicle having a relatively small engine room, the bulk of the engine makes mounting the engine in the same very difficult.

Accordingly, it is an object of the present invention to provide an improved steam engine system which is compact in size for readily mounting in a small space of an engine room of a passenger vehicle.

It is another object of the present invention to provide an improved steam engine system which can preferably increase the thermal efficiency of the system by recirculating the heat in the steam flowing from the expander.

It is still another object of the present invention to provide an improved steam engine system in which air used for burning the fuel in a combustion chamber of a steam generator is preheated by the heat in the steam released from the expander.

The other objects and merits of the steam engine system according to the present invention will become more apparent from the following description taken in conjunction with the accompanying single drawing which diagrammatically shows an embodiment of the improved steam engine system of the subject invention.

Referring now to the single drawing, there is schematically illustrated an embodiment of the improved steam engine system of the invention which comprises a steam generator 10. The steam generator 10 has therein a combustion chamber 12 into which fuel and air are introduced through an injection nozzle 14 projected into the combustion chamber 12 as shown.

For supplying the air into the injection nozzle 14, an air pump 16 is arranged to connect with the nozzle 14 through an air conduit or an air conduction tube 18.

The air conduction tube 18 has at the generally intermediate portion a section communicating with an air heating means which will be well described hereinlater.

Communicating with the air conduction tube 18 adjacent to the injection nozzle 14, through a first fuel conduction tube 20, is a fuel pump 22 which is connected through a second fuel conduction tube 24 to a fuel tank 26 for pumping the fuel toward the air conduction tube 18.

Referring back to the steam generator 10, an expander 28 is connected through a first steam conduit or conduction tube 30 to a steam outlet port of the steam generator 10. The expander 28 is a device, such as a steam turbine, which can convert the heat energy of the steam generated by the steam generator 10 into mechanical energy, for example in this case of a driving shaft 32 of a motor vehicle.

In the first conduction tube 30, there is provided a steam control valve (not shown) such as a throttle valve for controlling the amount of steam which is to be supplied from the steam generator 10 into the expander 28. Thus, the output power of the expander 28 is variably controlled by operating the control valve.

Connected downstream of the expander 28 through a second conduction tube 34 is an auxiliary condenser 36 which comprises a fin tube casing 37 having an air inlet port 37*a* and an air outlet port 37*b*. The fin tube casing 37 contains therein a fin tube 38 which has one end connected to the downstream portion of the second conduction tube 34. The other end of the fin tube 38 is connected to a main condenser 42 which will be described later. It is now to be noted that the auxiliary condenser 36 is so constructed to have a relatively small heat exchanging effect between the steam passing through the fin tube 38 and the air staying in the casing 37.

Communicating downstream of the auxiliary condenser 36 through a third conduction tube 40 is the main condenser 42 which has therein a fin tube 44 and is so constructed to have a relatively large cooling effect for causing the remaining steam from the auxiliary condenser 36 to be condensed into water.

Connected downstream of the main condenser 42 through a fourth conduction tube 46 is a circulating pump 48 which can supply the steam generator 10 with the water from the main condenser 42 through a fifth conduction tube 50.

Now, according to the present invention, the air used for burning the fuel in the combustion chamber is warmed or preheated on its way to the injection nozzle 14. For this purpose, the air conduction tube 18 providing communication between the air pump 16 and the injection nozzle 14 is connected to the fin tube casing 37 of the auxiliary condenser 36 in such a manner that the air passing from the air pump 16 can pass through the casing 37 before reaching the injection nozzle 14.

Thus, a certain amount of heat exchanging takes place between the air in the casing 37 and the steam in the fin tube 38, that is, a certain amount of heat energy of the steam is transferred to the air thereby causing the steam to be cooled and, in the same time, the air to be warmed.

When the above-stated steam engine system of the present invention is mounted in an engine room of a motor vehicle, the main condenser 42 is arranged at a well ventilated position of the engine room for better cooling thereof. However, the auxiliary condenser 36 may be positioned in any suitable space of the engine room, for example even in a space where good ventilation does not occur, since the steam in the fin tube 38 of the auxiliary condenser 36 is cooled or partially condensed into water only by the air passing through the casing 37.

The steam engine system of the present invention operates as follows:

After water in the steam generator 10 is vaporized to steam under high pressure and high temperature by the combustion of the fuel, the steam is introduced through the control valve (not shown) into the expander 18 for moving the driving shaft 32 of the vehicle. The steam from the expander 18, after losing a large amount of heat energy, is then introduced into the auxiliary condenser 36 through the second conduction tube 34.

During the passage of the steam along and within the fin tube 38 of the auxiliary condenser 36, a certain amount of heat exchanging is accomplished between the steam and the air surrounding the fin tube 38 so that a part of the heat energy of the steam is transferred to the air. Consequently, a part of the steam is cooled or condensed to water and, in the same time, the air is warmed.

By the assistance of the warmed air, perfect combustion of the fuel will be accomplished in the combustion chamber 12 thereby preferably increasing the thermal efficiency of the steam engine system of the invention.

The steam, from the auxiliary condenser 36, containing therein a relatively small amount of water is passed through the third conduction tube 40 and introduced into the main condenser 42. During the passage through and within the fin tube 44 of the main condenser 42, the remaining steam from the auxiliary condenser 36 is completely condensed into water. This condensing or heat exchanging effect of the main condenser 42 is increased when the air in the engine room is well ventilated therethrough as occurs when the vehicle is cruising.

If desired, a cooling fan (now shown) may be provided adjacent to the main condenser 42 in order to acheive more effective heat exchanging effect between the steam and the ventilating air. By the adoption of such a cooling fan, continuous and effective heat exchanging will be accomplished even when the vehicle is moving slowly.

The water from the main condenser 42 is pumped into the steam generator 10, through the fourth and fifth conduction tubes 46 and 50, by means of the circulating pump 48.

The arrows A illustrated in the drawing indicate the flowing direction of the steam and/or water recirculating in the sustem of the invention.

Although, in the above-stated construction of the steam engine system of the present invention, "water" is used as the working fluid, it is also possible to use other fluids such as "Freon," Ammonia, or other hydrocarbon fluids.

Further, although two condensers are employed in this embodiment, three or more condensers are possible. In this instance, at least one condenser among the condensers is employed for warming the air used for burning fuel in the steam generator.

While the present invention has been shown in only one embodiment, it will be ovbious to those skilled in the art that is not so limited, but is susceptible to various other changes and modifications without departing from the spirit thereof.

What is claimed is:

1. In a motor vehicle having a steam engine system including a steam generator with a combustion chamber into which fuel is introduced for the combustion thereof with air, an expander converting heat energy of steam from said steam generator into mechanical energy used for moving a driving shaft of said vehicle, steam cooling means cooling said steam from said expander so that said steam from said expander is finally condensed into water, and a circulating pump supplying said steam generator with water from said steam cooling means, the improvement in that said steam cooling means comprises a first condenser used for transferring the released heat given by said steam from said expander to the air used for burning said fuel in said combustion chamber, and a second condenser condensing steam from said first condenser to water therein, said first condenser being so constructed to be lower in its heat exchanging effect than that of said second condenser.

2. A motor vehicle as claimed in claim 1, in which said first condenser has a size thereof considerably smaller than that of said second condenser.

3. A motor vehicle as claimed in claim 2, in which said first condenser comprises:

a casing having a chamber with inlet and outlet openings, said inlet and outlet openings being respectively connected to an air pump and said combustion chamber so that the air from said air pump passes through the chamber of said casing before being introduced into said combustion chamber; and a fin tube spacedly disposed in said chamber of said casing, said fin tube having inlet and outlet open ends respectively communicating with said expander and said second condenser so that the steam from said expander gives the released heat to the air passing through said chamber before being introduced into said second condenser.

4. A motor vehicle as claimed in claim 3, in which said second condenser is arranged at a well ventilated position of an engine room of said motor vehicle and said first condenser is arranged in a less well ventilated position of the engine room.

* * * * *